US006025816A

United States Patent [19]

Dent et al.

[11] Patent Number: 6,025,816

[45] Date of Patent: Feb. 15, 2000

[54] ANTENNA SYSTEM FOR DUAL MODE SATELLITE/CELLULAR PORTABLE PHONE

[75] Inventors: Paul Dent, Pittsboro; Amer Hassan, Cary; James MacDonald, Apex; Yawei Ma, Cary, all of N.C.

[73] Assignee: Ericsson Inc., Research Triangle Park, N.C.

[21] Appl. No.: 08/773,661

[22] Filed: Dec. 24, 1996

[51] Int. Cl.[7] ..... H01Q 1/24; H01Q 1/36

[52] U.S. Cl. ..... 343/895; 343/700 MS; 343/702

[58] Field of Search ..... 343/895, 702, 343/700 MS; H01Q 1/24, 1/36

[56] References Cited

U.S. PATENT DOCUMENTS

| | | | |
|---|---|---|---|
| 3,503,075 | 3/1970 | Gerst | 343/895 |
| 4,127,831 | 11/1978 | Riblet | 333/10 |
| 4,349,824 | 9/1982 | Harris | 343/895 |
| 4,554,554 | 11/1985 | Olesen et al. | 343/895 |
| 4,559,539 | 12/1985 | Markowitz et al. | 343/725 |
| 4,608,574 | 8/1986 | Webster et al. | 343/895 |
| 4,783,661 | 11/1988 | Smith | 343/700 MS |
| 4,990,927 | 2/1991 | Ieda et al. | 343/700 MS |
| 5,043,738 | 8/1991 | Shapiro et al. | 343/700 MS |
| 5,170,176 | 12/1992 | Yasunaga et al. | 343/895 |
| 5,173,711 | 12/1992 | Takeuchi et al. | 343/700 MS |
| 5,198,831 | 3/1993 | Burrell et al. | 343/895 |
| 5,218,370 | 6/1993 | Blaese | 343/93 |
| 5,255,005 | 10/1993 | Terret et al. | 343/895 |
| 5,257,032 | 10/1993 | Diamond et al. | 343/730 |
| 5,313,216 | 5/1994 | Wang et al. | 343/700 MS |
| 5,319,378 | 6/1994 | Nalbandian et al. | 343/700 MS |
| 5,323,168 | 6/1994 | Itoh et al. | 343/700 MS |
| 5,349,365 | 9/1994 | Ow et al. | 343/895 |
| 5,353,035 | 10/1994 | Del Castillo Cuervo-Arango et al. | 343/700 MS |
| 5,403,197 | 4/1995 | Ernst et al. | 343/702 |
| 5,572,172 | 11/1996 | Standke et al. | 333/128 |
| 5,581,268 | 12/1996 | Hirshfield | 343/853 |
| 5,606,332 | 2/1997 | Darden, IV et al. | 343/790 |

FOREIGN PATENT DOCUMENTS

| | | |
|---|---|---|
| 0 169 823 A1 | 1/1986 | European Pat. Off. . |
| 0 320 404 A1 | 6/1989 | European Pat. Off. . |
| 0 805 513 A2 | 11/1997 | European Pat. Off. . |
| WO 97/11507 | 3/1997 | WIPO . |

*Primary Examiner*—Don Wong
*Assistant Examiner*—Hoang Nguyen
*Attorney, Agent, or Firm*—James P. Davidson

[57] ABSTRACT

An antenna operable in two disparate frequency bands is disclosed as including a first quadrifilar helix having four conductive elements arranged helically to define a cylinder of substantially constant radius, where the first quadrifilar helix is formed of two bifilar helices arranged orthogonally and excited in phase quadrature. A quadrature feed network is connected to the first quadrifilar helix, wherein one end of a coupling element thereof is connected to a first end of each conductive element. The quadrature feed network also includes a first feedpoint for operation of the antenna with circular polarization in a first frequency band and a second feedpoint for operation of the antenna with linear polarization in a second frequency band. The antenna may include a second quadrifilar helix connected to the quadrature feed network and having four conductive elements arranged helically to define a cylinder of substantially constant radius, where the second quadrifilar helix is formed by two bifilar helices arranged orthogonally and excited in phase quadrature. The second quadrifilar helix is wound in opposite sense with respect to the first quadrifilar helix so as to be conductively coupled therewith.

72 Claims, 6 Drawing Sheets

ANTENNA SYSTEM FOR DUAL MODE SATELLITE/CELLULAR PORTABLE PHONE

BACKGROUND OF THE INVENTION

1. Field of the Invention

The present invention relates generally to a dual mode satellite/cellular portable phone and, in particular, to an antenna system for a dual mode satellite/cellular portable phone.

2. Description of Related Art

Portable cellular phones are well known and have been utilized for the past several years. Such cellular phones typically transmit and receive signals at a frequency of approximately 800–950 Megahertz by means of an antenna designed for such purpose. Recently, however, it has become desirable for a second mode of communication, (e.g., satellite) to be employed in areas where cellular towers or stations are not available. Satellite communication occurs at frequencies much higher than for cellular communication (typically 1.0–3.0 Gigahertz) and likewise requires an antenna specifically designed for such communication. It will be understood that there are certain differences between an antenna utilized for cellular communication versus one utilized for satellite communication. One example is that the cellular antenna will preferably be linearly polarized so as to function as a monopole while the satellite antenna is circularly polarized in order to provide hemispherical coverage. A further distinction is that communication in the satellite mode involves a directional component (where link margin is increased when the satellite antenna is pointed toward the satellite), whereas communication in the cellular mode does not.

Because at least some of the characteristics desirable for the cellular and satellite antennas are inconsistent, one approach that has been taken is the antenna system shown and disclosed in a patent application entitled "Antenna System For Dual Mode Satellite/Cellular Portable Phone," Ser. No. 08/586,433, also filed by the assignee of the present invention. As seen therein, separate antennas were provided with a portable phone for cellular and satellite communication. While the antenna system disclosed by this patent application is adequate for its intended purpose, it will be noted that an antenna system having only a single antenna which can be utilized for both cellular and satellite modes of communication would be preferred from the standpoints of cost and aesthetics.

In light of the foregoing, a primary objective of the present invention is to provide an antenna system for a portable phone which enables the transmission and receipt of signals in both cellular and satellite modes of communication.

Another object of the present invention is to provide an antenna system for a dual mode satellite/cellular portable phone which includes only a single antenna for transmitting and receiving signals in cellular and satellite modes of communication.

A further object of the present invention is to provide an antenna system for a dual mode satellite/cellular portable phone which is mounted so as to enable better link margin with respect to an applicable satellite.

Yet another object of the present invention is to provide an antenna system for a dual mode satellite/cellular portable phone which minimizes the need for manipulation by the user thereof.

Still another object of the present invention is to provide an antenna system for a dual mode satellite/cellular portable phone which is aesthetically pleasing to the user thereof.

Another object of the present invention is to provide an antenna system for a dual mode satellite/cellular portable phone which minimizes the overall impact on size of the portable phone.

A still further object of the present invention is to provide an antenna system for a dual mode satellite/cellular portable phone which permits the use of separate frequency subbands for transmitting and receiving signals within the satellite and cellular modes of communication.

These objects and other features of the present invention will become more readily apparent upon reference to the following description when taken in conjunction with following drawing.

SUMMARY OF THE INVENTION

In accordance with one aspect of the present invention, an antenna operable in two disparate frequency bands is disclosed as including a first quadrifilar helix having four conductive elements arranged helically to define a cylinder of substantially constant radius, where the first quadrifilar helix is formed of two bifilar helices arranged orthogonally and excited in phase quadrature. A quadrature feed network is connected to the first quadrifilar helix, wherein one end of a coupling element thereof is connected to a first end of each conductive element. The quadrature feed network also includes a first feedpoint for operation of the antenna with circular polarization in a first frequency band and a second feedpoint for operation of the antenna with linear polarization in a second frequency band. The antenna may include a second quadrifilar helix connected to the quadrature feed network and having four conductive elements arranged helically to define a cylinder of substantially constant radius, where the second quadrifilar helix is formed by two bifilar helices arranged orthogonally and excited in phase quadrature. The second quadrifilar helix is wound in opposite sense with respect to the first quadrifilar helix so as to be electromagnetically decoupled therefrom.

In accordance with a second aspect of the present invention, an antenna for transmitting and receiving signals within a first frequency band and a second frequency band is disclosed as including a flexible sheet of film having a first side and a second side, a first metallized pattern formed on the first side of the film sheet having a plurality of spiral arms connected to a coupler, and a second metallized pattern formed on the second side of the film sheet having a plurality of spiral arms connected to a coupler. The film sheet is formed into a cylindrical tube having a longitudinal axis therethrough so that a first coaxial quadrifilar helix is constructed by the spiral arms of the first metallized pattern and a second coaxial quadrifilar helix is constructed by the spiral arms of the second metallized pattern, with the first and second quadrifilar helices being wound in an opposite sense to avoid electromagnetic coupling therebetween.

In accordance with a third aspect of the present invention, a portable phone having RF circuitry contained within a main housing for operating the portable phone in both cellular and satellite modes is disclosed. More specifically, an antenna assembly for such portable phone is disclosed as including a base member connected to the main housing of the portable phone and a radome member rotatably connected to the base member, where the radome member contains therein a printed antenna which is able to transmit and receive signals in the cellular and satellite modes of operation. The antenna assembly may also include a hinge member rotatable within the base member, wherein the radome member is connected at one end of such hinge member so as to be rotatable about an axis between a first position adjacent a side surface of the main housing and a second position. Additionally, an elbow member is preferably connected to the hinge member at a first end and the radome member at a second end so that the hinge and radome members are substantially perpendicular in orientation.

In accordance with a fourth aspect of the present invention, a quadrifilar helix antenna is disclosed as including a flexible sheet of dielectric film with first and second pairs of conductive arms printed upon the flexible sheet of dielectric film in such manner that the conductive arms form a quadrifilar helix when the flexible sheet is rolled into a cylindrical tube. A balanced 90° branch line coupler is also printed on the flexible sheet of dielectric film, wherein the coupler is able to provide two balanced output signals in phase quadrature relative to each other. The coupler further includes a first output port connected to the first pair of conductive arms which has a first terminal for providing an in-phase portion of a first output signal to one of the first pair of conductive arms and a second terminal for providing an anti-phase portion of the first output signal to the other of the first pair of conductive arms. The coupler also includes a second output port connected to the second pair of conductive arms in which the second output port has a first terminal for providing an in-phase portion of a second output signal to one of the second pair of conductive arms and a second terminal for providing an anti-phase portion of the second output signal to the other of the second pair of conductive arms. The coupler has at least one input port for receiving an input signal and splitting the input signal between the first and second pairs of conductive arms in relative phase progression so as to be radiated with circular wave polarization.

BRIEF DESCRIPTION OF THE DRAWING

While the specification concludes with claims particularly pointing out and distinctly claiming the present invention, it is believed the same will be better understood from the following description taken in conjunction with the accompanying drawing in which:

DETAILED DESCRIPTION OF THE INVENTION

Figure 1:
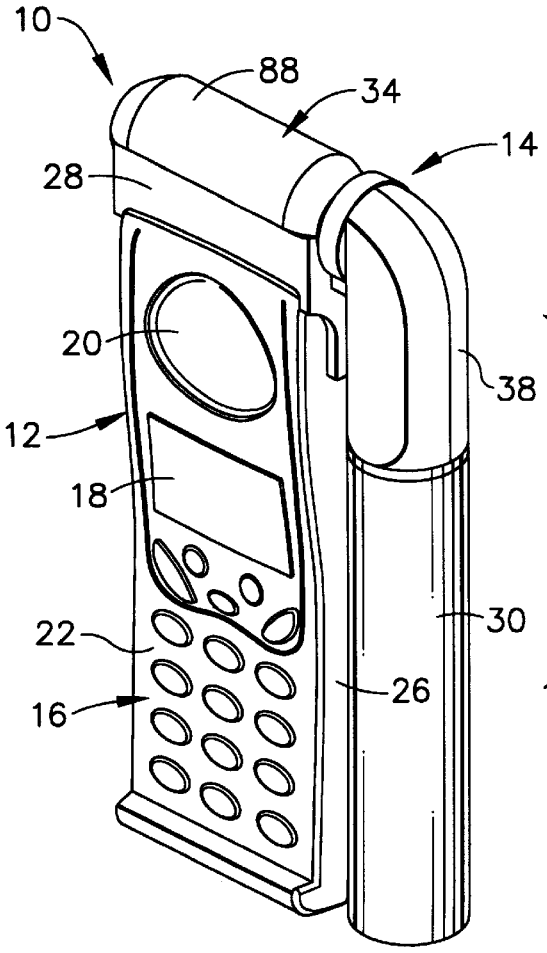
FIG. 1 is a perspective view of a handheld portable phone operable in both satellite and cellular modes of communication including the antenna assembly of the present invention, where the radome member of the antenna assembly is in a first position.

Referring now to the drawing in detail, wherein identical numerals indicate the same elements throughout the figures, FIG. 1 depicts a handheld portable phone 10 which is operable in the dual modes of satellite and cellular communication. It will be seen that portable phone 10 has a main housing 12 and preferably an antenna assembly 14 in accordance with the present invention which transmits and receives signals within certain specified frequency bands of operation. A keypad 16, display 18, and speaker 20 are provided along a front surface 22 of main housing 12 to permit a user to operate portable phone 10 in the normal manner. Of course, it will be understood that main housing 12 has RF circuitry located therein enabling portable phone 10 to communicate in both the cellular and satellite modes of communication. While not shown, exemplary RF circuitry is shown and described in a patent application entitled "Dual Mode Satellite/Cellular Terminal," Ser, No. 08/501,575, which is owned by the assignee of the present invention and is hereby incorporated by reference.

Figure 2:
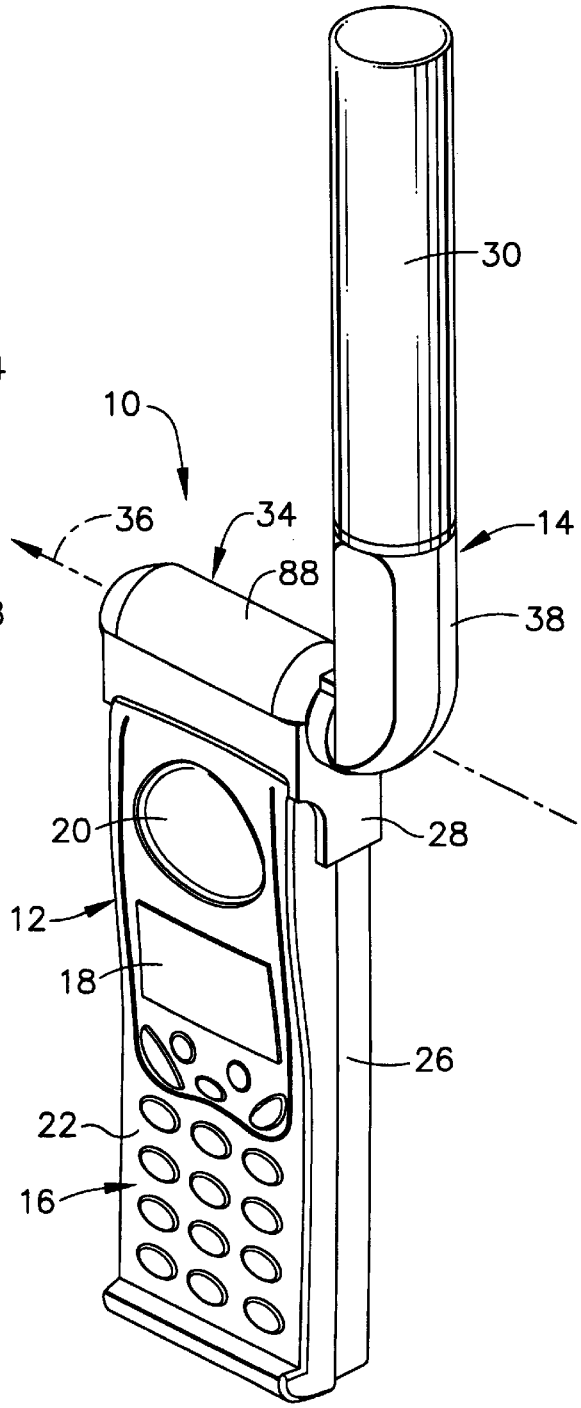
FIG. 2 is a perspective view of the handheld portable phone depicted in FIG. 1, where the radome member of the antenna assembly is in a second position.

With respect to antenna assembly 14, it will be noted from FIGS. 1 and 2 that it preferably is located adjacent to a top surface 24 (see FIG. 3) and one side surface 26 of main housing 12 and therefore has a substantially L-shaped configuration (although it could just as easily be located along the other side of main housing 12). Antenna assembly 14 is preferably detachably secured to main housing 12 and includes a base member 28 connecting antenna assembly 14 to main housing 12, a radome member 30 containing a printed antenna 32 therein (to be discussed in greater detail hereinafter), a hinge member 34 which enables radome member 30 to rotate about an axis 36 between a first position adjacent side surface 26 (shown in FIG. 1) to a second position substantially 180° from the first position (shown in FIG. 2), and an elbow member 38 which connects radome member 30 to hinge member 34 and rotates about axis 36 in conjunction with radome member 30. It will be understood that radome member 30 is maintained in the first position when it is not in use or in a standby mode to minimize the overall size of portable phone 10, as antenna assembly 14 will slightly increase the overall height and width of portable phone 10 from that of main housing 12. In this first position, the impact on ease of holding and transporting portable phone 10 is minimized. Otherwise, radome member 30 and elbow member 38 of antenna assembly 14 are rotated to the second position when used to transmit or receive signals.

Figure 3:
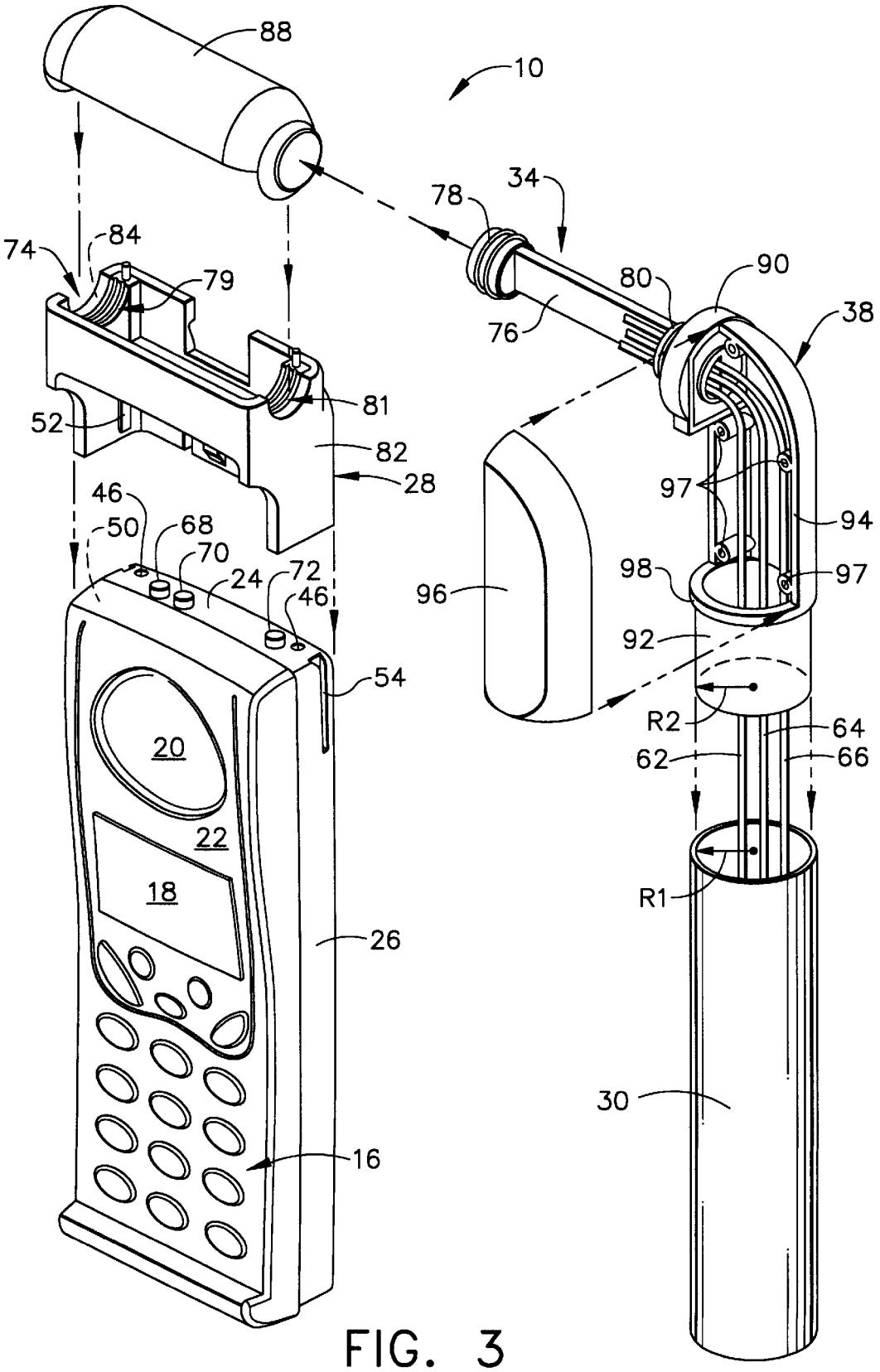
FIG. 3 is an exploded, perspective view of the antenna assembly with the portable phone depicted in FIGS. 1 and 2.
Figure 4:
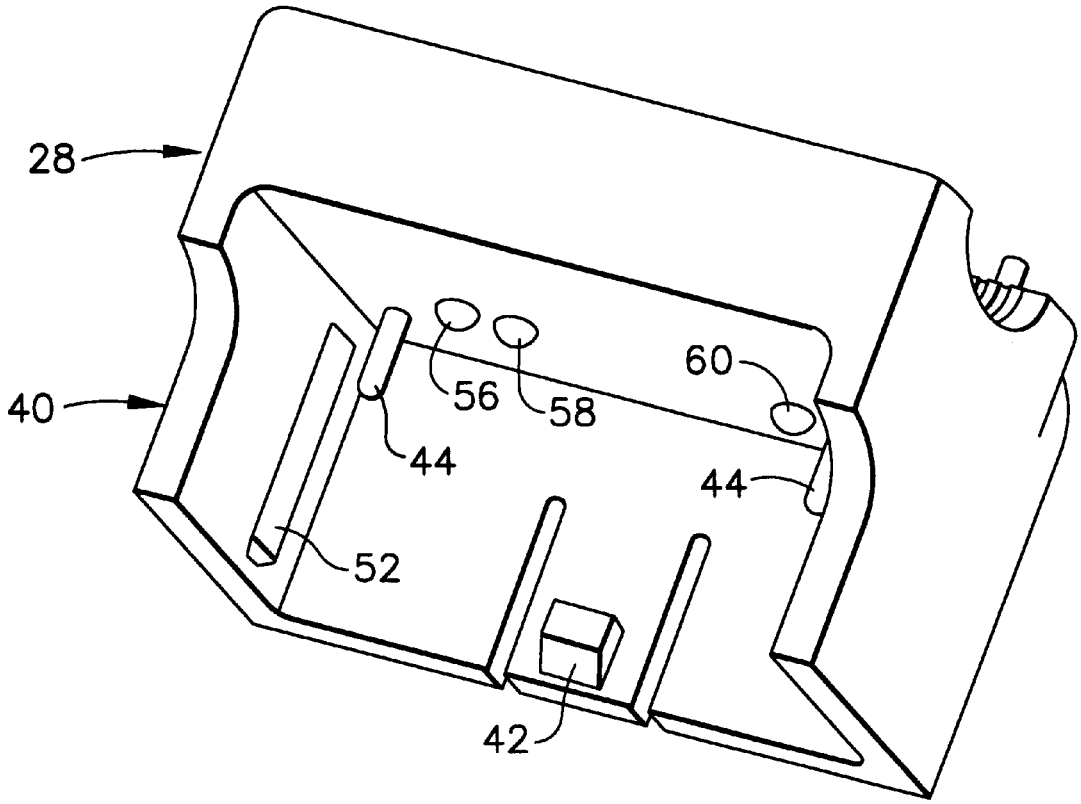
FIG. 4 is a bottom perspective view of the base member for the antenna assembly depicted in FIGS. 1–3.

As indicated hereinabove, antenna assembly 14 preferably is detachably mounted to main housing 12 by means of base member 28. Accordingly, base member 28 may be constructed similarly to a support bracket assembly used to detachably mount a flip cover to the main housing of a portable phone shown and described in a patent application entitled "Detachable Flip Cover Assembly For A Portable Phone," Ser. No. 08/586,434, which is owned by the assignee of the present invention and is hereby incorporated by reference. Thus, as shown in FIGS. 3 and 4, base member 28 preferably includes a first slotted portion 40 which is sized to receive top surface 24 and a portion of main housing 12. A latching mechanism, preferably in the form of a detent 42 which is positioned to be received in a recess (not shown) in a rear surface of main housing 12, is provided to couple base member 28 to main housing 12. In order to facilitate the mounting of base member 28 to main housing 12, first slotted portion 40 of base member 28 preferably has at least one guide pin 44 positioned therein which is received within a corresponding opening 46 in main housing 12, as well as a dovetail-type guide located on at least one of main housing side surfaces 26 and 50. Each dovetail-type guide includes a male member 52 located within first slotted portion 40 of base member 28 and a complementary female member 54 associated with main housing 12. Connectors 56, 58, and 60 are located within first slotted portion 40 of base member 28 and connected to one end of coaxial cables 62, 64, and 66, respectively, with the other end of coaxial cables 62, 64, and 66 being connected to printed antenna 32. Complementing this arrangement, connectors 68, 70, and 72 are coupled to the internal RF circuitry and extend from top surface 24 of main housing 12 so as to be aligned with and mated to connectors 56, 58, and 60 when base member 28 is mounted to main housing 12. In this way, the RF circuitry of portable phone 10 is properly connected to printed antenna 32 of antenna assembly 14.

Base member 28 further includes a second slotted portion 74 opposite first slotted portion 40, where hinge member 34 of antenna assembly 14 is rotatably mounted thereto. In this way, portable phone 10 permits flexibility in the positioning of printed antenna 32 by a user thereof, whereby the signal strength is maximized (when in the satellite mode of communication) by pointing printed antenna 32 toward an applicable satellite. More specifically, hinge member 34 includes a rotary joint shaft 76 that extends through a pair of rotary joint bearings 78 and 80 positioned within grooved slots 79 and 81, respectively, immediately to the interior of end walls 82 and 84 of base member 28. It will be noted that rotary joint shaft 76, as well as rotary joint bearings 78 and 80, preferably has a D-shaped cross-section in order to prevent radome member 30 of antenna assembly 14 from over-rotating about axis 36 (the preferred range of rotation being approximately 180° in one direction or the other). One end of rotary joint shaft 76 is preferably retained to elbow member 38 of antenna assembly 14 while the other end preferably has a swivel cap attached thereto (not shown). As seen in FIG. 3, a removable covering 88 optionally is secured to base member 28 in order to protect hinge member 34 from dirt and other contaminants.

Elbow member 38 of antenna assembly 14 has rotary joint shaft 76 connected thereto at a first end 90 and radome member 30 connected at a second end 92 (which generally will be oriented substantially 90° with respect to first end 90). As seen in FIG. 3, elbow portion 38 is hollow and includes a side opening 94 therein which is covered by a removable access cap 96. Preferably, access cap 96 is frictionally retained to elbow member 38, such as by a male-female configuration (a plurality of female portions 97 being seen in FIG. 3). Likewise, radome member 30 may be secured to second end 92 of elbow member 38 by means of a friction fit. In this regard, FIG. 3 depicts radome member 30 as being substantially a cylindrical tube having an inner radius $R_1$ slightly greater than an outer radius $R_2$ of cylindrical second end 92 of elbow member 38, where radome member 30 is able to slide over such cylindrical second end 92 until it is seated against a lip 98.

It will be understood that the hollow nature of both rotary joint shaft 76 and elbow member 38 enables coaxial cables 62, 64 and 66 to be connected to printed antenna 32 in radome member 30 at one end and to connectors 56, 58 and 60 at the other end by means of openings (not shown) in rotary joint shaft 76. In particular, signals transmitted to an applicable satellite via printed antenna 32 are sent from the RF circuitry in main housing 12 through coaxial cable 62, signals received by printed antenna 32 from an applicable satellite are sent to the RF circuitry in main housing 12 through coaxial cable 64, and coaxial cable 66 is utilized to both transmit signals to and receive signals from printed antenna 32 when portable phone 10 is in the cellular (monopole) communication mode. In order to maintain coaxial cables 62, 64, and 66 in the proper shape, as well as produce a minimum bend radius, prevent chafing of the cables and reduce fatigue failures of the jacket material under flexing conditions, it is preferred that the outer jackets thereof be heat formed as described in a patent application entitled "Coaxial Cable Assembly For A Portable Phone," Ser. No. 08/613,700, which is also owned by the assignee of the present invention and hereby incorporated by reference.

With respect to radome member 30 of antenna assembly 14, it has been noted that a printed antenna 32 preferably is located therein. Although printed antenna 32 is rolled into a cylindrical tube to be in the desired shape for radome member 30 (as seen in FIG. 7), it will be best understood by referring to the planar top and rear views thereof in FIGS. 5 and 6. As seen therein, printed antenna 32 preferably is constructed of a flexible film sheet 100 made of a dielectric material (e.g., mylar, fiberglass, kevlar, or the like). Film sheet 100 has a front surface 102 with a metallized layer 104 applied thereto in a desired pattern (see FIG. 5) and a rear surface 106 with a second metallized pattern 108 applied thereto of a predetermined design (see FIG. 6). More particularly, front metallized layer 104 has a pair of spiral arms 105 and 107 and rear metallized layer 108 has a pair of spiral arms 109 and 111 which are configured so that printed antenna 32 has a quadrifilar helix design when film sheet 100 is rolled into a cylindrical tube, as best seen in FIG. 7. It will be understood that front and rear metallized layers 104 and 108 are preferably printed on film sheet 100, with the dimensions thereof being photographically reproduced. Spiral arms 105, 107, 109, and 111, for their part, typically will have a length substantially equivalent to either a quarter wavelength or a three-quarter wavelength of the desired frequencies of operation.

It will be further understood that the cylindrical tube into which film sheet 100 is rolled preferably has a controlled diameter D (see FIG. 7). One approach for performing this task is to wrap film sheet 100 about a mandrel and glue the overlapping portions which extend more than 360°. The mandrel would then be removed once the glue has dried. By so forming film sheet 100, it will be seen that a quadrifilar helix 101 is formed by spiral arms 105, 107, 109 and 111 since they are wound in the same sense.

A balanced 90° branch line coupler 110, made by printed patterns on front and rear metallized layers 104 and 108, is preferably used to provide the four-phase drive signals to spiral arms 105, 107, 109, and 111 of printed antenna 32. It will be understood that coupler 110 is an adaptation of an unbalanced branch line coupler described in U.S. Pat. No. 4,127,831 to Riblet. Instead of the unbalanced form in Riblet where a branch line coupler pattern is printed on one side of a dielectric layer with a ground plane on the other side thereof, coupler 110 of the present invention includes two identical coupler patterns placed back-to-back on front and back surfaces 102 and 106 of dielectric film sheet 100. Coupler 110 thus has a balanced construction in which square conductors 112 (front metallized layer 104) and 114 (rear metallized layer 108) are separated by dielectric film sheet 100. Of course, coupler 110 provides the connection between printed antenna 32 and coaxial cables 62, 64, and 66 so that printed antenna 32 is connected to the RF circuitry in portable phone 10.

Figure 5:
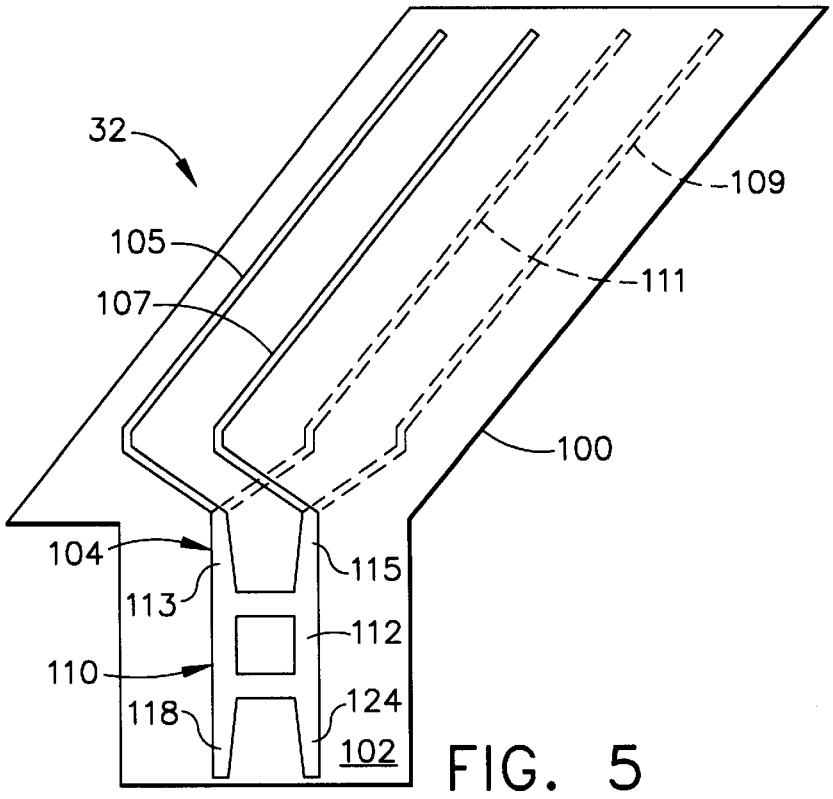
FIG. 5 is a planar front view of a first embodiment for the printed antenna located within the radome member of the antenna assembly depicted in FIGS. 1–3.
Figure 6:
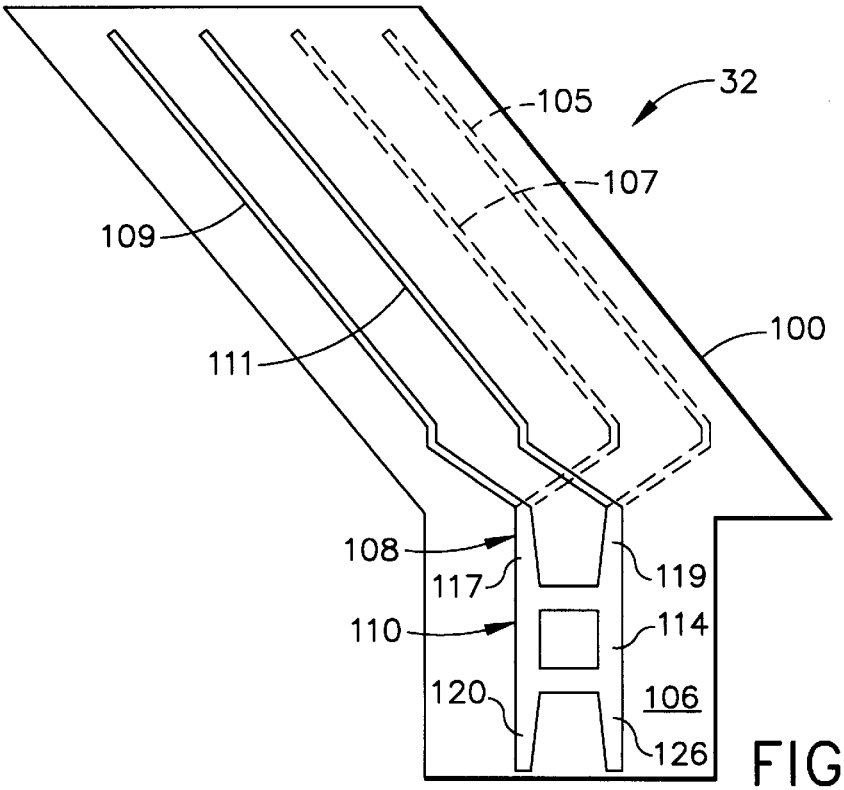
FIG. 6 is a planar rear view of the printed antenna depicted in FIG. 5.
Figure 7:
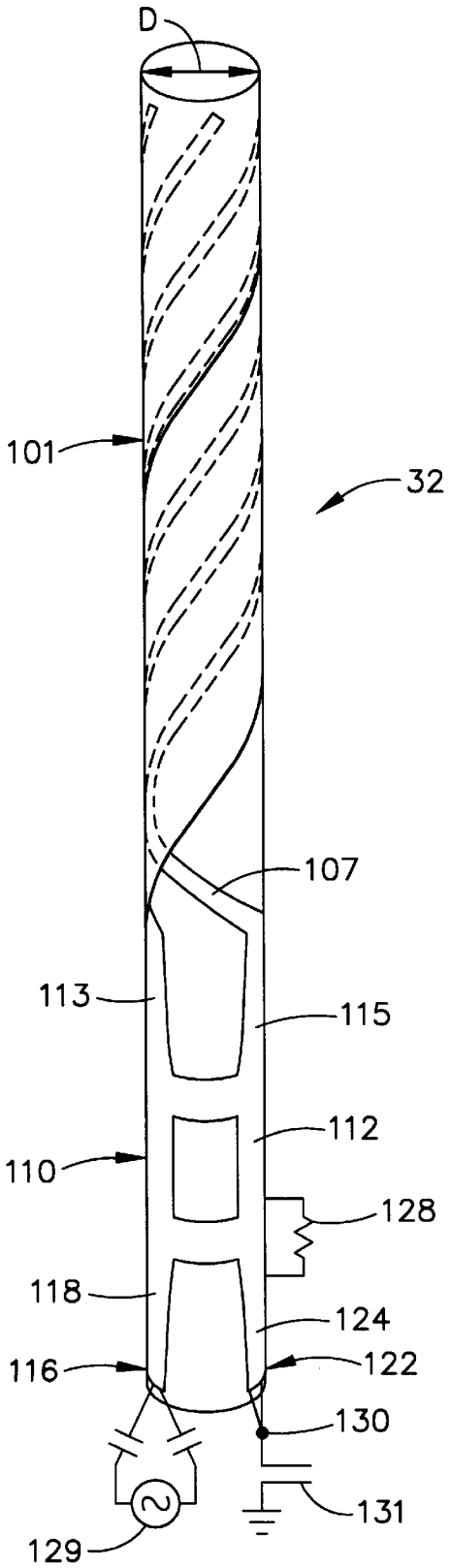
FIG. 7 is a front view of the printed antenna depicted in FIGS. 5 and 6 after being formed into a cylindrical tube configuration, where electrical elements associated with the various feedpoints of the antenna are schematically depicted.

It will be noted from FIGS. 5 and 6 that spiral arms 105 and 111 are connected to a first output of coupler 110 made up of upper legs 113 and 119 extending from square conductors 112 and 114, respectively. Likewise, spiral arms 107 and 109 are connected to a second output of coupler 110 formed by upper legs 115 and 117 extending from square conductors 112 and 114, respectively. In this way, upper legs 113 and 115 will carry the in-phase portion and upper legs 117 and 119 will carry the anti-phase portion of the output signal from coupler 110. It will further be seen from FIG. 7 that coupler 110 has a first input port 116 including lower legs 118 and 120 of square conductors 112 and 114, respectively, which printed antenna 32 uses for transmitting frequency $f_1$ and receiving frequency $f_2$ while in the satellite mode of communication (coupler 110 being balanced and quadrifilar helix 101 having circular polarization) and a second input port 122 including lower legs 124 and 126 of square conductors 112 and 114, respectively, which printed antenna 32 uses for frequency $f_3$ (both transmitting and receiving) while in the cellular or monopole mode of communication (coupler 110 being unbalanced and quadrifilar helix 101 having linear polarization).

More specifically, it will be seen in FIG. 7 that a dummy load 128 is provided across lower legs 124 and 126 of second input port 122 in order to terminate the balanced mode of coupler 110 at second input port 122. In this way, only satellite frequencies $f_1$ and $f_2$ are able to be used during the balanced mode of coupler 110 since their feedpoint 129 is attached to first input port 116. A short circuit 130 is provided between front and rear metallized layers 104 and 108 in order to place coupler 110 in an unbalanced mode, with feedpoint 131 being utilized for cellular frequency $f_3$. Short circuit 130 preferably is located approximately a quarter-wavelength away from dummy load 128 so that it appears as an open circuit.

Figure 10:
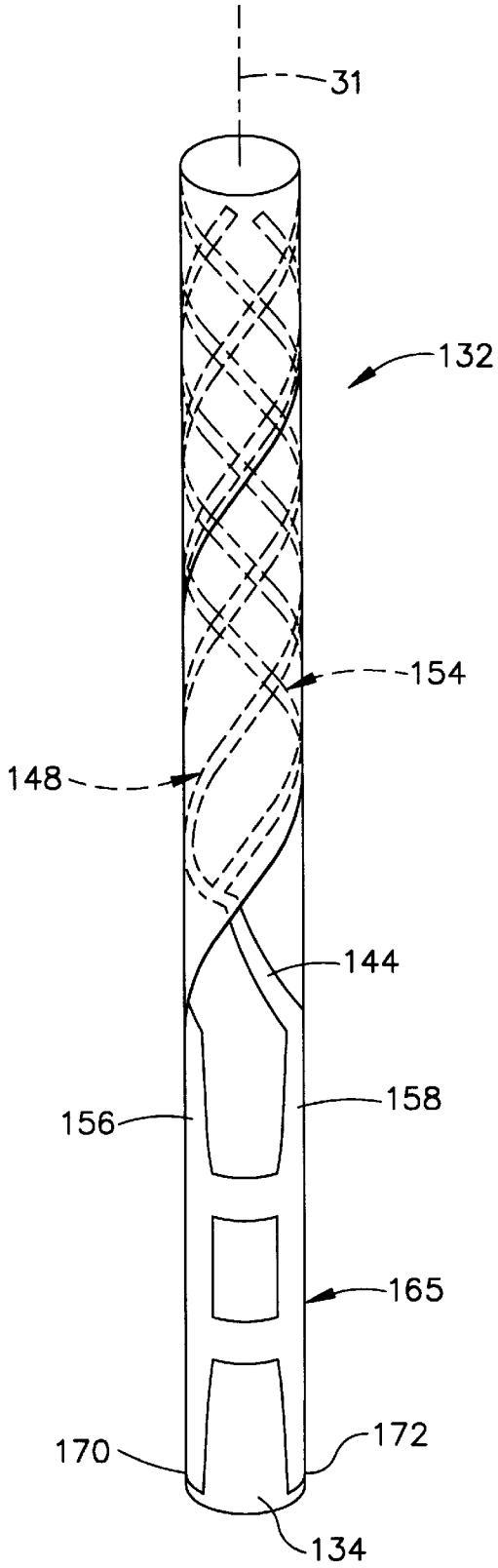
FIG. 10 is a front view of the printed antenna depicted in FIGS. 8 and 9 after being formed into a cylindrical tube configuration.
Figure 8:
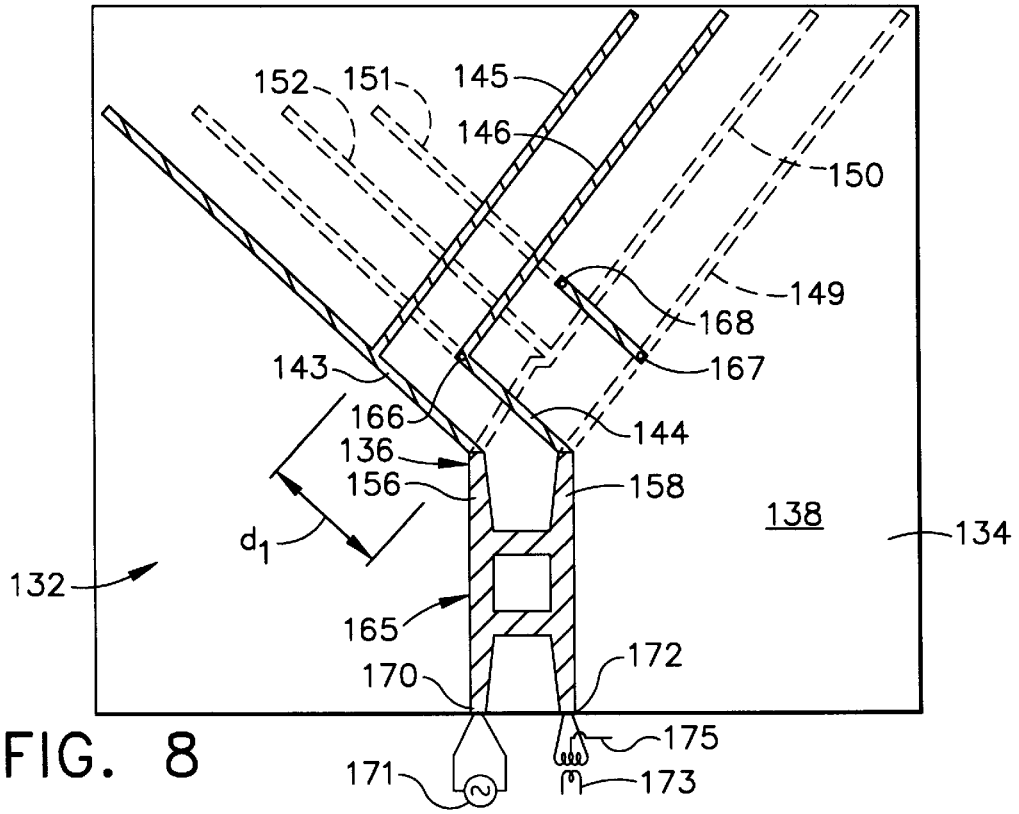
FIG. 8 is a planar front view of a second embodiment for the printed antenna located within the radome member of the antenna assembly depicted in FIGS. 1–3, where electrical elements associated with the various feedpoints of the antenna are schematically depicted.
Figure 9:
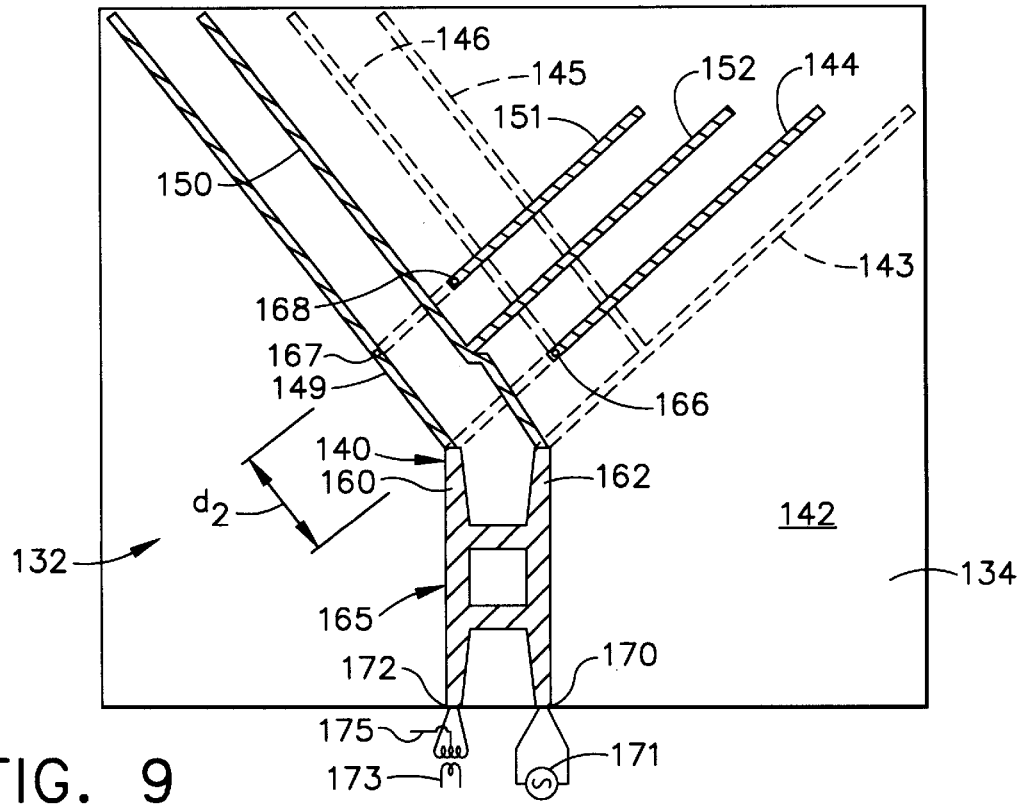
FIG. 9 is a planar rear view of the printed antenna depicted in FIG. 8, where the electrical elements associated with the various feedpoints of the antenna are also schematically depicted.

A second embodiment for the printed antenna, designated by the numeral 132, is depicted in FIGS. 8–10. As explained hereinabove with respect to printed antenna 32, a flexible film sheet 134 is provided in which a first metallized layer 136 is applied to a front surface 138 thereof and a second metallized layer 140 is applied to a rear surface 142. A first pair of spiral arms 143 and 144 are provided in accordance with metallized layer 136 and connected to upper legs 156 and 158 of a coupler 165 like that previously described. Spiral arms 143 and 144 are in substantially parallel relation as they extend from upper legs 156 and 158. After traveling a distance $d_1$, spiral arm 143 has a spiral arm 145 branch off therefrom substantially perpendicular thereto and spiral arm 144 likewise has a spiral arm 146 branch off substantially perpendicular thereto. It will be seen from FIGS. 8 and 9 that spiral arm 143 continues along front surface 138 of film sheet 134 while spiral arm 144 enters a plated via 166 and thereafter extends in the same direction along rear surface 142 of film sheet 134.

A second set of spiral arms 149 and 150 are provided by metallized layer 140 and connected to upper legs 160 and 162 of coupler 165. Spiral arms 149 and 150 are oriented substantially parallel to each other as they extend from upper legs 160 and 162. After traveling a distance $d_2$, spiral arm 149 has a spiral arm 151 branch off substantially perpendicular thereto. It will be seen that spiral arm 149 enters a plated via 167 so that spiral arm 151 travels along front surface 138 of film sheet 134 until it passes spiral arm 150, after which spiral arm 151 enters another plated via 168 and extends along rear surface 142 of film sheet 134. It will also be seen that a spiral arm 152 branches off substantially perpendicularly from spiral arm 150. Accordingly, spiral arms 150 and 152 extend along rear surface 142 of film sheet 134 for a specified length. It will be understood that when film sheet 134 is wrapped into a cylindrical tube configuration, a first quadrifilar helix 148 is formed by spiral arms 143, 144, 145, and 146 of front metallized layer 136 and a second quadrifilar helix 154 is formed by spiral arms 149, 150, 151, and 152. It will be noted that none of the spiral arms for each quadrifilar helix touch where they cross, which is why plated vias 166, 167, and 168 are strategically provided. This prevents electromagnetic coupling between first and second quadrifilar helices 148 and 154. It will also be understood that both first quadrifilar helix 148 and second quadrifilar helix 154 are coaxial with a longitudinal axis 31 through printed antenna 132, with first quadrifilar helix 148 being located concentrically outside of second quadrifilar helix 154.

Since printed antenna 132 has a three-mode configuration, a feedpoint 171 for a first satellite frequency band (having a circular polarization in a given direction) is connected to a first input port 170 of coupler 165 and a feedpoint 173 for a second satellite frequency band (having a circular polarization opposite that of the first satellite frequency band) is connected to a second input port 172 of coupler 165. In this way, separate frequency bands for transmitting and receiving signals may be utilized with printed antenna 132. It will be understood that first quadrifilar helix 148 is preferably adapted to the lower of the frequency bands and that second quadrifilar helix 154 is adapted to the higher of the frequency bands (since spiral arms 143, 144, 145 and 146 are longer than spiral arms 149, 150, 151, and 152). Of course, coupler 165 is in a balanced mode when either the first frequency band or the second frequency band are provided to printed antenna 132 in order to provide circular polarization. By contrast, a third frequency band used for transmitting and receiving cellular signals is provided printed antenna 132 when coupler 165 is in an unbalanced mode, where one of first quadrifilar helix 148 and second quadrifilar helix 154 is linearly polarized as a monopole and the other acts as a parasitic element. Accordingly, the third frequency band may utilize either first input port 170 or second input port 172 as its feedpoint 175 (although it is shown as being connected to second input port 172 in FIGS. 8 and 9).

Having shown and described the preferred embodiment of the present invention, further adaptations of the antenna assembly described herein can be accomplished by appropriate modifications by one of ordinary skill in the art without departing from the scope of the invention.

PARTS LIST

| | |
|---|---|
| 10 | dual mode satellite/cellular portable phone (generally) |
| 12 | main housing |
| 14 | antenna assembly (generally) |
| 16 | keypad |
| 18 | display |
| 20 | speaker |

-continued

PARTS LIST

| | |
|---|---|
| 22 | front surface of main housing |
| 24 | top surface of main housing |
| 26 | side surface of main housing |
| 28 | base member of antenna assembly |
| 30 | radome member of antenna assembly |
| 31 | longitudinal axis through radome member |
| 32 | printed antenna |
| 34 | hinge member of antenna assembly |
| 36 | axis of rotation |
| 38 | elbow member of antenna assembly |
| 40 | first slotted portion of base member |
| 42 | detent |
| 44 | guide pin(s) |
| 46 | opening(s) for receipt of guide pin(s) |
| 50 | side surface of main housing |
| 52 | male member of dovetail-type guide |
| 54 | female member of dovetail-type guide |
| 56 | coaxial connector |
| 58 | coaxial connector |
| 60 | coaxial connector |
| 62 | coaxial cable for transmitting satellite signals |
| 64 | coaxial cable for receiving satellite signals |
| 66 | coaxial cable for transmitting/receiving cellular signals |
| 68 | coaxial connector on main housing |
| 70 | coaxial connector on main housing |
| 72 | coaxial connector on main housing |
| 74 | second slotted portion of base member |
| 76 | rotary joint shaft |
| 78 | rotary joint bearing |
| 79 | grooved slot |
| 80 | rotary joint bearing |
| 81 | grooved slot |
| 82 | end wall of base member |
| 84 | end wall of base member |
| 88 | covering for hinge member |
| 90 | first end of elbow member |
| 92 | second end of elbow member |
| 94 | side opening in elbow member |
| 96 | access cap to elbow member opening |
| 97 | female portions of access cap connection |
| 98 | lip of elbow member |
| 100 | flexible dielectric sheet of printed antenna |
| 101 | quadrifilar helix |
| 102 | front surface of film sheet |
| 104 | metallized layer on front surface of film sheet |
| 105 | spiral arm on front metallized layer |
| 106 | rear surface of film sheet |
| 107 | spiral arm on front metallized layer |
| 108 | metallized layer on rear surface of film sheet |
| 109 | spiral arm on rear metallized layer |
| 110 | coupler |
| 111 | spiral arm on rear metallized layer |
| 112 | square conductor on front metallized layer |
| 113 | upper leg of square conductor 112 |
| 114 | square conductor on rear metallized layer |
| 115 | upper leg of square conductor 112 |
| 116 | first input port of coupler |
| 117 | upper leg of square conductor 114 |
| 118 | lower leg of square conductor 112 |
| 119 | upper leg of square conductor 114 |
| 120 | lower leg of square conductor 114 |
| 122 | second input port of coupler |
| 124 | lower leg of square conductor 112 |
| 126 | lower leg of square conductor 114 |
| 128 | dummy load |
| 129 | feedpoint of satellite frequencies |
| 130 | short circuit |
| 131 | feedpoint of cellular frequency |
| 132 | printed antenna (alternative configuration---three mode) |
| 134 | film sheet |
| 136 | metallized layer on front surface |
| 138 | front surface of film sheet |
| 140 | metallized layer on rear surface |
| 142 | rear surface of film sheet |
| 143 | spiral arm on front metallized layer |
| 144 | spiral arm on front metallized layer |
| 145 | spiral arm on front metallized layer |

-continued

PARTS LIST

| | |
|---|---|
| 146 | spiral arm on front metallized layer |
| 148 | first quadrifilar helix |
| 149 | spiral arm on rear metallized layer |
| 150 | spiral arm on rear metallized layer |
| 151 | spiral arm on rear metallized layer |
| 152 | spiral arm on rear metallized layer |
| 154 | second quadrifilar helix |
| 156 | upper leg of coupler (front metallized layer) |
| 158 | upper leg of coupler (front metallized layer) |
| 160 | upper leg of coupler (rear metallized layer) |
| 162 | upper leg of coupler (rear metallized layer) |
| 165 | coupler |
| 166 | plated via |
| 167 | plated via |
| 168 | plated via |
| 169 | via |
| 170 | first port of coupler |
| 171 | feedpoint for a first satellite frequency band |
| 172 | second port of coupler |
| 173 | feedpoint for a second satellite frequency band |
| 175 | feedpoint for a cellular frequency band |
| $R_1$ | inner radius of radome member |
| $R_2$ | outer radius of elbow member second end |
| $f_1$ | transmit frequency for satellite mode of communication |
| $f_2$ | receive frequency for satellite mode of communication |
| $f_3$ | transmit/receive frequency for cellular mode of communication |

What is claimed is:

1. An antenna operable in two disparate frequency bands, comprising:

(a) a first quadrifilar helix including four conductive elements arranged helically to define a cylinder of substantially constant radius, said first quadrifilar helix being formed of two bifilar helices arranged orthogonally and excited in phase quadrature; and (b) a quadrature feed network connected to said first quadrifilar helix, wherein one end of a coupling element thereof is connected to a first end of each said conductive element, said quadrature feed network further comprising:

(1) a first feedpoint connected to a first pair of said conductive elements, said coupling element being balanced and said first quadrifilar helix having circular polarization, wherein said antenna is operable in a first frequency band; and (2) a second feedpoint connected to a second pair of said conductive elements, said coupling element being unbalanced and said first quadrifilar helix having linear polarization, wherein said antenna is operable in a second frequency band.

2. The antenna of claim 1, wherein said first frequency band is within a satellite mode of operation.

3. The antenna of claim 2, wherein said antenna is operable in said first frequency band for transmitting a signal and said antenna is operable in a third frequency band for receiving a signal.

4. The antenna of claim 1, wherein said second frequency band is within a cellular mode of operation.

5. The antenna of claim 4, wherein said antenna is operable in said second frequency band for transmitting and receiving a signal.

6. The antenna of claim 1, said antenna further comprising a sheet of dielectric material, wherein said conductive elements and said coupling element are printed thereon.

7. The antenna of claim 6, wherein said first pair of said conductive elements are printed on a first surface of said dielectric sheet and said second pair of said conductive elements are printed on a second surface of said dielectric sheet.

8. The antenna of claim 1, further comprising a second quadrifilar helix connected to said quadrature feed network and having four conductive elements arranged helically to define a cylinder of substantially constant radius, said second quadrifilar helix being formed of two bifilar helices arranged orthogonally and excited in phase quadrature, wherein said second quadrifilar helix is wound in an opposite direction from said first quadrifilar helix with respect to a longitudinal axis for said helices.

9. The antenna of claim 8, wherein said respective conductive elements of said first and second quadrifilar helices are conductively coupled.

10. The antenna of claim 8, wherein the lengths of said conductive elements for said first quadrifilar helix are greater than the lengths of said conductive elements for said second quadrifilar helix.

11. The antenna of claim 8, wherein said second quadrifilar helix is positioned concentrically inside said first quadrifilar helix.

12. The antenna of claim 11, wherein said frequency band within which said second quadrifilar helix is operable is greater than said frequency band within which said first quadrifilar helix is operable.

13. The antenna of claim 12, wherein said first quadrifilar helix is utilized to transmit signals during a satellite mode of operation.

14. The antenna of claim 12, wherein said second quadrifilar helix is utilized to receive signals during a satellite mode of operation.

15. The antenna of claim 8, wherein the radius of said first quadrifilar helix is greater than the radius of said second quadrifilar helix.

16. The antenna of claim 8, wherein one of said first and second quadrifilar helices is fed with a different circular mode so that said antenna is operable in a monopole mode within a third frequency band.

17. The antenna of claim 8, wherein one of said first and second quadrifilar helices is fed with a different circular mode and the other of said helices acts as a parasitic element so that said antenna is operable in a monopole mode within a third frequency band.

18. The antenna of claim 17, wherein said conductive elements of said driven quadrifilar helix are fed in phase.

19. The antenna of claim 8, said quadrature feed network further comprising a balanced 90° branchline coupler connected to said first and second quadrifilar helices.

20. The antenna of claim 8, said first and second quadrifilar helices further comprising a dielectric film with a metallized pattern formed on each side thereof, said film being wrapped and fixed in a cylindrical shape.

21. The antenna of claim 8, said quadrature feed network further comprising a third feedpoint for a third frequency band.

22. The antenna of claim 1, said quadrature feed network further comprising a dummy load across said second feedpoint to terminate the balancing of said coupling element thereacross when a signal is provided to said first feedpoint.

23. The antenna of claim 1, said quadrature feed network further comprising a short circuit across said first and second feedpoints to create an unbalanced condition for said coupling element when a signal is provided to said second feedpoint.

24. An antenna for transmitting and receiving signals within a first frequency band and a second frequency band, comprising:

(a) a flexible sheet of film having a first side and a second side;

(b) a first metallized pattern formed on said first side of said film sheet including a plurality of spiral arms connected to a coupler; and (c) a second metallized pattern formed on said second side of said film sheet including a plurality of spiral arms connected to a coupler;

wherein said film sheet is formed into a cylindrical tube having a longitudinal axis therethrough so that a first coaxial quadrifilar helix is constructed by said spiral arms of said first metallized pattern and a second coaxial quadrifilar helix is constructed by said spiral arms of said second metallized pattern, said first and second quadrifilar helices being wound in opposite directions with respect to said longitudinal axis to avoid electromagnetic coupling therebetween.

25. The antenna of claim 24, wherein said first and second quadrifilar helices are conductively coupled to provide opposite sense circular polarization in said first and second frequency bands.

26. The antenna of claim 24, wherein said film sheet is made of a dielectric material.

27. The antenna of claim 24, wherein the lengths of said spiral arms of said first quadrifilar helix are greater than the lengths of said spiral arms of said second quadrifilar helix.

28. The antenna of claim 24, wherein said second quadrifilar helix is positioned concentrically inside said first quadrifilar helix.

29. The antenna of claim 28, wherein said first quadrifilar helix is utilized to transmit signals during a satellite mode of operation.

30. The antenna of claim 28, wherein said second quadrifilar helix is utilized to receive signals during a satellite mode of operation.

31. The antenna of claim 24, wherein the radius of said first quadrifilar helix is greater than the radius of said second quadrifilar helix.

32. The antenna of claim 24, wherein one of said first and second quadrifilar helices is fed with a different circular mode so that said antenna is operable in a monopole mode within a designated frequency band.

33. The antenna of claim 24, further comprising a quadrature feed network connected to said first and second quadrifilar helices.

34. In a portable phone having RF circuitry contained within a main housing for operating said portable phone in both cellular and satellite modes, an antenna assembly comprising:

(a) a base member connected to a top portion of said portable phone main housing; and (b) a radome member rotatably connected to said base member, said radome member containing a printed antenna therein which is able to transmit and receive signals in said cellular and satellite modes of operation.

35. The antenna assembly of claim 34, further comprising a hinge member connected to said radome member which is rotatably engaged to said base member, wherein said radome member is rotatable about an axis between a first position adjacent a side surface of said main housing and a second position.

36. The antenna assembly of claim 35, further comprising an elbow member connected to said hinge member at a first end and connected to said radome member at a second end.

37. The antenna assembly of claim 36, wherein said radome member is oriented substantially perpendicular to said hinge member.

38. The antenna assembly of claim 36, wherein said antenna assembly is substantially L-shaped.

39. The antenna assembly of claim 36, further comprising a plurality of coaxial cables connected to said printed antenna in said radome member at one end and to corresponding connectors located on said main housing at a second end, wherein said printed antenna is connected to said RF circuitry.

40. The antenna assembly of claim 39, said coaxial cables being positioned through said radome member, said elbow member, said hinge member and said base member.

41. The antenna assembly of claim 36, said elbow member further comprising an access opening therein and an access cap removably mounted thereto.

42. The antenna assembly of claim 35, wherein said radome member is located at said first position during off and standby modes of said portable phone.

43. The antenna assembly of claim 35, wherein said radome member is located at said second position during transmission and reception of signals.

44. The antenna assembly of claim 35, said axis of rotation for said antenna assembly being oriented substantially parallel to a top surface of said main housing.

45. The antenna assembly of claim 34, wherein said base member is detachably mounted to said main housing of said portable phone.

46. The antenna assembly of claim 34, wherein said radome member is shaped substantially as a cylindrical tube.

47. The antenna assembly of claim 34, said printed antenna further comprising:

(a) a flexible film sheet made of dielectric material having a first side and a second side;

(b) a first metallized pattern applied to said first side of said flexible film sheet; and (c) a second metallized pattern applied to said second side of said flexible film sheet;

wherein at least one quadrifilar helix is formed when said flexible film sheet is rolled into a cylindrical tube and positioned within said radome member.

48. The antenna assembly of claim 47, wherein said first metallized layer includes a first pair of spiral arms and said second metallized layer includes a second pair of spiral arms oriented so as to form a quadrifilar helix.

49. The antenna assembly of claim 48, wherein said first and second pairs of spiral arms have a length substantially equivalent to a quarter wavelength of a desired frequency of operation.

50. The antenna assembly of claim 48, wherein said first and second pairs of spiral arms have a length substantially equivalent to a three-quarter wavelength of a desired frequency of operation.

51. The antenna assembly of claim 48, further comprising a coupler connected to said printed antenna, wherein said printed antenna has a circular polarization when said coupler is balanced and said printed antenna has a linear polarization when said coupler is unbalanced.

52. The antenna assembly of claim 51, said coupler further comprising a first port for said quadrifilar helix when in a circular polarization mode and a second port for said quadrifilar helix when in a linear polarization mode.

53. The antenna assembly of claim 52, said coupler further comprising a dummy load connected to said second port of said coupler so as to terminate the balanced mode of said coupler at said second port.

54. The antenna assembly of claim 52, further comprising a short circuit between said first and second metallized layers of said printed antenna, said short circuit acting as a feedpoint for said printed antenna when said coupler is in said unbalanced mode.

55. The antenna assembly of claim 47, wherein said first metallized layer includes a first set of spiral arms to form a first quadrifilar helix of a first designated radius and said second metallized layer includes a second set of spiral arms to form a second quadrifilar helix of a second designated radius.

56. The antenna assembly of claim 55, wherein said spiral arms of said first quadrifilar helix have a length greater than said spiral arms of said second quadrifilar helix.

57. The antenna assembly of claim 55, wherein said spiral arms of said first quadrifilar helix are wound in an opposite direction from said spiral arms of said second quadrifilar helix with respect to a longitudinal axis of said cylinder tube.

58. The antenna assembly of claim 55, wherein the radius of said first quadrifilar helix is greater than the radius of said second quadrifilar helix.

59. The antenna assembly of claim 55, wherein said spiral arms of said first quadrifilar helix do not touch said spiral arms of said second quadrifilar helix where they cross.

60. The antenna assembly of claim 55, said first and second metallized patterns further comprising a balanced quadrature branch-line coupler connecting said printed antenna to a plurality of coaxial cables, wherein a spiral arm from each of said first and second quadrifilar helices is connected to each leg of said coupler.

61. The antenna assembly of claim 60, said printed antenna further comprising a plurality of plated vias in said flexible film sheet so that a spiral arm of said first and second metallized patterns connected to a leg of said coupler is able to branch off, extend through one of said plated vias, and provide a spiral arm on the opposite metallized pattern.

62. The antenna assembly of claim 60, said coupler providing a first port for said first quadrifilar helix and a second port for said second quadrifilar helix.

63. The antenna assembly of claim 62, further comprising an open circuit in one of said first and second coupler ports so that said printed antenna operates with a linear polarization when a frequency is provided thereto.

64. The antenna assembly of claim 63, wherein the quadrifilar helix associated with the coupler port in which said open circuit is not provided acts as a parasitic element.

65. The antenna assembly of claim 60, wherein said printed antenna operates with a circular polarization when said coupler is in a balanced mode.

66. The antenna assembly of claim 60, wherein said printed antenna operates with a linear polarization when said coupler is in an unbalanced mode.

67. The antenna assembly of claim 55, wherein said first quadrifilar helix is adapted for a signal frequency less than said second quadrifilar helix.

68. A quadrifilar helix antenna, comprising:

(a) a flexible sheet of dielectric film;

(b) a first pair and a second pair of conductive arms printed upon said flexible sheet of dielectric film in such manner that said conductive arms form a quadrifilar helix when said flexible sheet is rolled into a cylindrical tube; and (c) a balanced 90° branch line coupler printed on said flexible sheet of dielectric film, wherein said coupler is able to provide two balanced output signals in phase quadrature relative to each other, said coupler further comprising:

(1) a first output port connected to said first pair of conductive arms, said first output port having a first terminal for providing an in-phase portion of a first output signal to one of said first pair of conductive arms and a second terminal for providing an anti-phase portion of said first output signal to the other of said first pair of conductive arms;

(2) a second output port connected to said second pair of conductive arms, said second output port having a first terminal for providing an in-phase portion of a second output signal to one of said second pair of conductive arms and a second terminal for providing an anti-phase portion of said second output signal to the other of said second pair of conductive arms; and (3) at least one input port for receiving an input signal and splitting said input signal between said first and second pairs of conductive arms in relative phase progression so as to be radiated with circular wave polarization.

69. The quadrifilar helix antenna of claim 68, wherein said first pair of conductive arms are in diametrically opposed relation and said second pair of arms are in diametrically opposed relation.

70. The quadrifilar helix antenna of claim 69, wherein said first pair of conductive arms and said second pair of conductive arms are interposed at approximately 90° with respect to each other.

71. The quadrifilar helix antenna of claim 68, wherein one of said first pair and one of said second pair of conductive arms is positioned on a first surface of said flexible sheet and the other of said first and second pairs of conductive arms is positioned on a second surface of said flexible sheet.

72. The quadrifilar helix antenna of claim 68, wherein said coupler has a second input port which is unbalanced so that an input signal provided thereto is split between said conductive arms in a manner so as to be radiated with a linear wave polarization.

* * * * *